United States Patent [19]

Klygis

[11] 4,066,166

[45] Jan. 3, 1978

[54] BOTTLE MULTIPACKAGE

[75] Inventor: Mindaugas Julius Klygis, Barrington, Ill.

[73] Assignee: Illinois Tool Works Inc., Chicago, Ill.

[21] Appl. No.: 723,827

[22] Filed: Sept. 16, 1976

[51] Int. Cl.[2] ..... B65D 75/56; B65D 65/38; B65D 85/62

[52] U.S. Cl. ..... 206/427; 206/45.33; 206/390; 229/54 R; 150/12

[58] Field of Search ..... 206/427, 390, 45.33, 206/497; 229/62, DIG. 30, 54 R, 69; 150/12, 1

[56] References Cited

U.S. PATENT DOCUMENTS

| | | | |
|---|---|---|---|
| 3,774,838 | 11/1973 | Christie | 229/62 |
| 3,834,528 | 10/1974 | Pickford et al. | 229/DIG. 3 |
| 3,837,478 | 9/1974 | Cunningham | 206/427 |
| 3,961,743 | 6/1976 | Hollowell | 206/390 |

*Primary Examiner*—William T. Dixson, Jr.
*Attorney, Agent, or Firm*—Edward L. Benno; Robert W. Beart

[57] ABSTRACT

A multipackage of a group of bottles and a bag-like or bundling device. The group of bottles are arranged in two adjacent rows and in transverse ranks perpendicular to the rows. The bag-like device is formed from a thin flexible material and essentially comprises three elements, a band portion that securely encircles the sidewall peripheral surface of the group of bottles, a bottom wall that is integrally connected between the lower edges of at least two sidewalls of the device, and an upper portion that comprises a gathered and secured arrangement of at least a pair of flaps integrally connected to the upper ends of two opposed sidewalls of the device. The gathered and secured flaps are arranged to form tensioned truss elements that extend diagonally from opposite corners of the group of bottles. The securement of the tensioned truss elements is substantially at the height of the bottle caps of the group of bottles and substantially midway between the bottles of the center rank of bottles. Importantly, the formed truss elements are sufficiently tensioned to substantially prevent skewing of the group of bottles out of the transverse ranks perpendicular to the rows. Further importantly, the tensioned truss elements in the area of their securement is of a reduced cross section and circumferentially open to form a handle element capable of being encircled by a person's finger for convenient transport of the package. In such a carrying arrangement, the load of the bottles in the bag-like device is effectively directed from substantially the entire circumferential band portion through the tensioned truss elements to the handle element.

17 Claims, 12 Drawing Figures

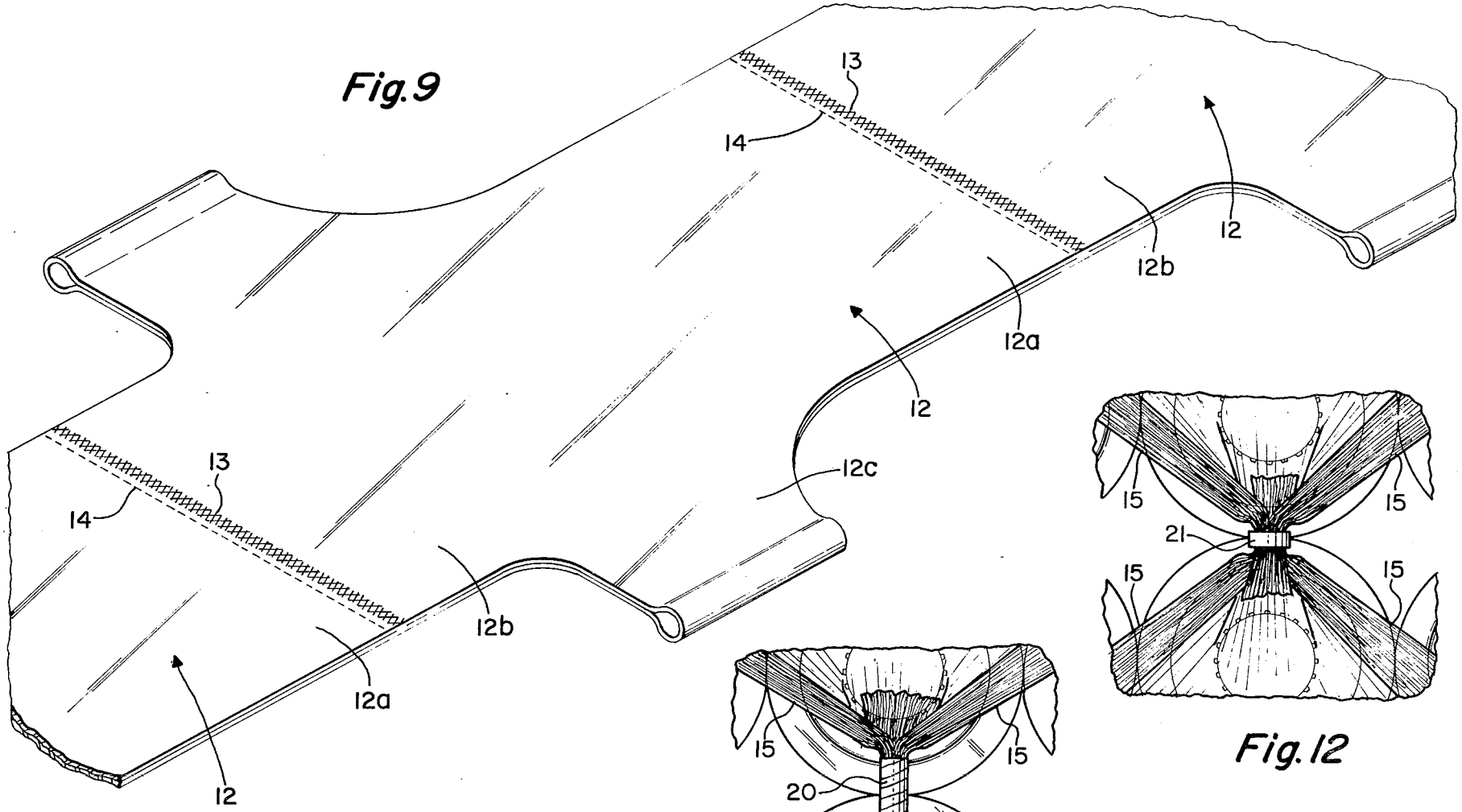
Fig. 9
Fig. 12
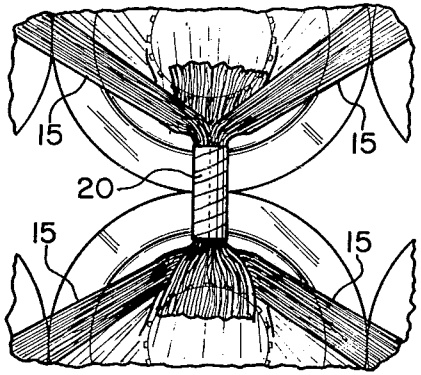
Fig. 11

BOTTLE MULTIPACKAGE

BACKGROUND OF THE INVENTION

Many bag-like or bundling devices are known in the prior art for the multipackaging of bottles. Problems encountered in the art involve such questions as what can be done to prevent bottles from skewing in a package, how can the bottles be shielded in a package to protect the contents of the bottles where those contents are light-sensitive or to reduce the potential of flying glass fragments where the bottles are made of glass subject to fracture and the contents are under pressure, how to provide an effective handle or other means for carrying of the package, and lastly, and perhaps most importantly, how to produce such packages at low cost to render them economically acceptable.

Arrangements are known in the prior art for in one way or another solving one or more of the noted foregoing problems or questions involved in the art of multipackaging bottles. In some instances, paperboard baskets and wraps have proved effective. In other arrangements, bottle dividers or individual bottle containment in the package has proved effective. In one large area of the prior art thin material known as heat shrink films have been used in an attempt to solve the economic problems of the art.

The background of the subject invention is not in the fields of either paperboard devices or heat shrink films, but in the field of devices that involve what may be called bundling or firm securing of a wraparound device securing a group of objects. The subject invention further involves the use of bag-like devices formed of resilient flexible plastics materials that are capable of being stretched and tensioned about groups of relatively heavy bottles.

SUMMARY OF THE INVENTION

The package of the subject invention involves bottles or containers arranged in two adjacent rows and in transverse ranks perpendicular to the rows. The bottles of the package are most typically bottles as are common in the beverage industries having a capped upper end of a substantially smaller diameter than the main body portion of the bottle. Such bottles have various neck shapes generally diverging downwardly from the capped upper end to the main body portion. Oftentimes such bottles are made of glass, and further the contents are often under pressure as is common with carbonated beverages such as soft drinks commonly referred to as "soda pop", and beer.

The arrangement of bottles or containers described above are to be multipackaged with a bag-like or bundling device formed from a thin flexible material. Reductions to practice of the invention have established that the unique arrangement of the elements of the package, and particularly the upper portion of the bag-like device, enables one to make the package of much thinner materials than heretofore believed practical. Package integrity, inherent strength, and high load carrying capabilities are no problem when one can use inherently strong and heavy or reinforced materials. Such an easy solution, however, is generally commercially unacceptable for large commercial applications involving millions of packages because of the relatively high cost of such materials. In successful reductions to practice of the subject invention, the bag-like device of the subject invention was made from a low density polyethylene material which was 2 mils in thickness. The six bottles in the package weighed a total of approximately seven pounds or approximately 3200 grams, and the bag-like device weighed just under 6 grams. Those skilled in this art will appreciate the remarkably light-weight of the bag-like device relative to the bottle load achieved in the practice of the subject invention.

The bag-like or bundling device that substantially envelops and multipackages the described bottles may be defined as comprising three integrally interconnected cooperating elements. The first element is a band portion that securely encircles the sidewall peripheral surface of the group of bottles. The second element is the bottom wall which is integrally connected between the lower edges of at least two sidewalls of the band portion. The third element is the top portion of the package and is made from two flaps of the material of the bag-like device that are integrally connected to the upper edges of at least two opposed sidewalls of the band portion. Those two flaps are gathered and secured together between the caps of the bottles of the center rank of bottles. The gathering and securement of the two flaps is such as to form two secured intersecting and substantially tensioned truss elements that extend substantially diagonally from opposite corners of the group of bottles. Various securement means are contemplated for making the secured intersection of the tensioned truss elements. With some materials the secured intersection may be formed by a tie knot of the flap material. By way of example, other securement means may comprise a tape wrapped about the intersection or a metal C-shaped ring that is clamped tightly about the intersection. Preferably, the secured intersection is of a reduced cross section and circumferentially open to permit a person to grasp the package by hooking one or two fingers underneath and about the secured circumferentially open intersection.

Three important features of the invention reside in the defined construction. The first feature is that the gathered flaps essentially receive the bottle load as a substantially distributed load circumferentially of the band portion and direct the load substantially uniformly through the defined truss elements of the handle. The second feature is that the defined handle is simple, convenient and comfortable for a person to use in carrying the package. The third feature is that the tensioned truss elements substantially prevent skewing of the group of bottles out of the transverse ranks perpendicular to the rows. As those skilled in this art will appreciate, mere bundling of a plurality of round or substantially cylindrical objects in a rectangular pattern tends to produce an unstable bundle because such objects may easily slip into a smaller area by assuming a parallelogram configuration. Such a prallelogram configuration can be produced by compression forces applied between diagonally opposed corners of such a bundle. However, in constructions made according to the present invention, compression forces applied between one pair of diagonally opposed corners will in reaction be opposed by the tensioned truss element extending between the other two diagonally opposed corners of the group. Further, the secured intersection will prevent slipping of the truss elements about the group of bottles. Thus, the secured intersecting tensioned truss elements in combination with the band portion and the bottom wall effectively prevent the group of bottles in the package from skewing out of the rectangular pattern into a parallelogram pattern.

The primary object of the present invention is to provide a multipackage of a group of bottles arranged in two adjacent rows and in transverse ranks perpendicular to the rows with a thin flexible material formed as a bag-like device in which a minimum of material is used to produce a stable, non-skewing package arrangement substantially protective of the bottles, convenient to carry, and economical to manufacture.

Other objects and features of the invention will be apparent upon a perusal of the hereinafter following detailed description read in conjunction with the drawings.

DETAILED DESCRIPTION OF THE DRAWINGS

FIG. 9 is an enlarged isometric view of a portion of the strip of bag-like devices of FIG. 8;

FIG. 11 is a fragmentary top plan view of a multipackage of FIGS. 2 or 6 showing another embodiment of the securement of the intersecting tensioned truss elements; and FIG. 12 is a view similar to FIG. 11, but showing a further form or embodiment of the securement.

DETAILED DESCRIPTION OF THE PREFERRED EMBODIMENTS

FIGS. 1 - 7 show a group of bottles 10. The shape of those bottles as shown is only one example of a bottle shape that may be used in the invention and it is to be understood that many other bottle shapes may be used in making multipackages of the subject invention. For example, bottles having a long tapering neck are contemplated in the subject invention. The general bottle shape limitations of bottles intended to be multipackaged within the teachings of the present invention are substantially round bottles or containers usually having reduced diameter caps such as caps 11. The caps 11 are of a diameter substantially smaller than the main body portion of the bottles and the necks of the bottles between the caps 11 and the main body portions diverge generally in a downward direction. Although in a preferred embodiment the bottles 10 are made of glass, other container materials may be used to form effective multipackages within the teachings of the invention.

In the embodiment of FIGS. 1 - 4, the group of bottle containers 10 form a multipackage with a bag-like device 12.

Figure 8:
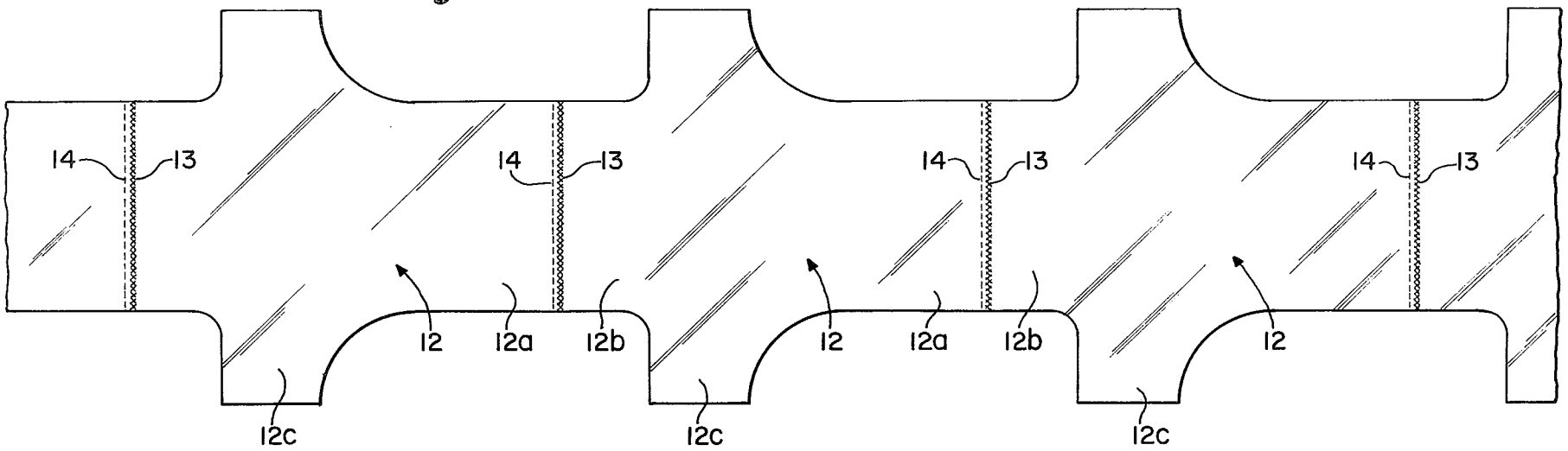
FIG. 8 is a reduced plan view of a plurality of the bag-like devices used to make the multipackage of FIGS. 1 - 4 showing the bag-like devices in one embodiment of their manufacture.

One preferred arrangement for making the bag-like device 12 is shown in FIGS. 8 and 9. As shown therein, a strip of bag-like devices 12 which may be conveniently wound upon a reel for handling are formed from a tube of thin flexible material. The invention contemplates that in some embodiments the thin flexible material of the tube may be a resilient elastic plastics material such as low density polyethylene or polypropylene. Those skilled in the art will understand that the thickness of the material of the tube may vary over a relatively wide range dependent upon the particular material selected, and the size and weight of the bottles and their contents. For example, with a material such as low density polyethylene, a material thickness of about 2 mils. may be used for multipackaging 12 fluid ounce glass beverage bottles, shaped as shown at 10 in the drawing. Where, again for example, a material such as polypropylene is used, a material thickness of about 1 mil. may prove entirely satisfactory for bag-like devices 12 for multipackaging six 12-ounce glass bottles, shaped such as bottles 10.

The tubular material from which the bag-like devices 12 of FIGS. 8 and 9 are made may be formed by blowing or casting processes. An advantage of the tubular material of FIGS. 8 and 9 is that the band portion of the bag-like device 12 that encircles the group of bottles does not have a seam. Many heat sealed or seamed tubes of various thermoplastic materials presently known are relatively weak in the area of the heat sealed seam relative to the unseamed portions of the tube. However, if a tubular material other than a thermoplastic material is selected, or if a thermoplastic material or seaming method is found in which the seam has substantially the strength of the material, the tubular material of FIGS. 8 and 9 may then be formed from a sheet material that has been folded into a tubular shape and seamed longitudinally of the tube.

As shown in FIGS. 8 and 9, the flattened tube is cut or otherwise punched along opposed sides of the tube and at spaced intervals longitudinally thereof to define through the longitudinal extent of each cut or punch the side marginal edge of the flap **12*a* of one bag-like device 12 and an adjacent bottom wall 12*b* of an adjoining bag-like device 12. In a preferred further manufacture of the devices 12, the flattened cut tube material is heat sealed along the line 13 and perforated along the line 14 as shown in FIGS. 8 and 9. From the foregoing description and FIGS. 8 and 9, it may be seen that individual bag-like devices 12 may be separated from the strip by separating adjacent bag-like devices 12 along the lines of perforation 14**.

Note should be made of the showing in FIGS. 8 and 9 of the flaps **12*a* having the same width as the length of the bottom wall 12*b*. In reductions to practice of the invention, it has been found that such a strip configuration produces a bag-like device 12 of substantially a minimum of material. The band portion 12*c* of each bag-like device forms the four integrally interconnected sidewalls of the bag-like device 12 for encircling the peripheral sidewall surface of the group of bottles 10. Preferably, the total circumferential extent of the band portion 12*c* should be no greater than the circumferential dimension of the outer peripheral sidewall surface defined by the group of bottles 10 when aligned in the rectangular and abutting pattern shown in FIG. 2. If the selected material of the bag-like device has substantial resiliency and elasticity, the circumferential dimension of the portion 12***c* may be made sufficiently smaller than the peripheral sidewall dimension of the group of bottles to provide for a resilient urging of the group of bottles together in the described pattern. The height of the band portion 12*c* is preferably great enough to substantially span the main body portion of the bottles 10.

Figure 1:
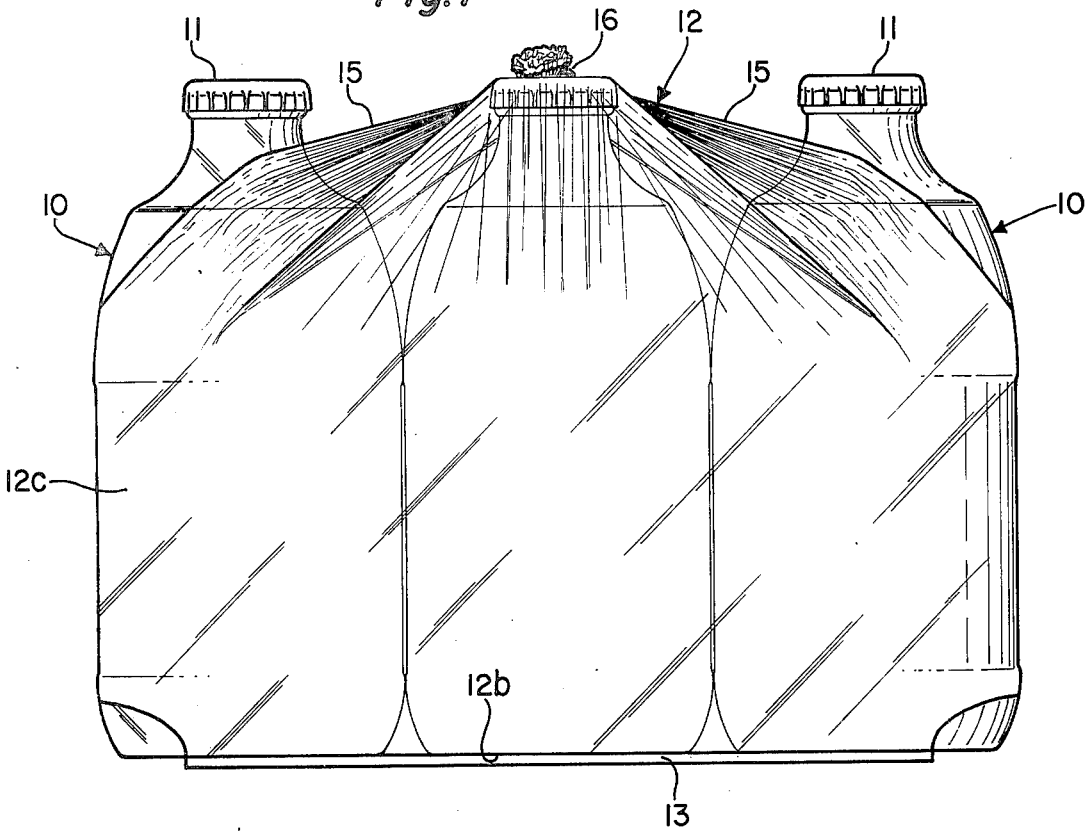
FIG. 1 is a side elevational view of one embodiment of a multipackage constructed according to the invention.
Figure 2:
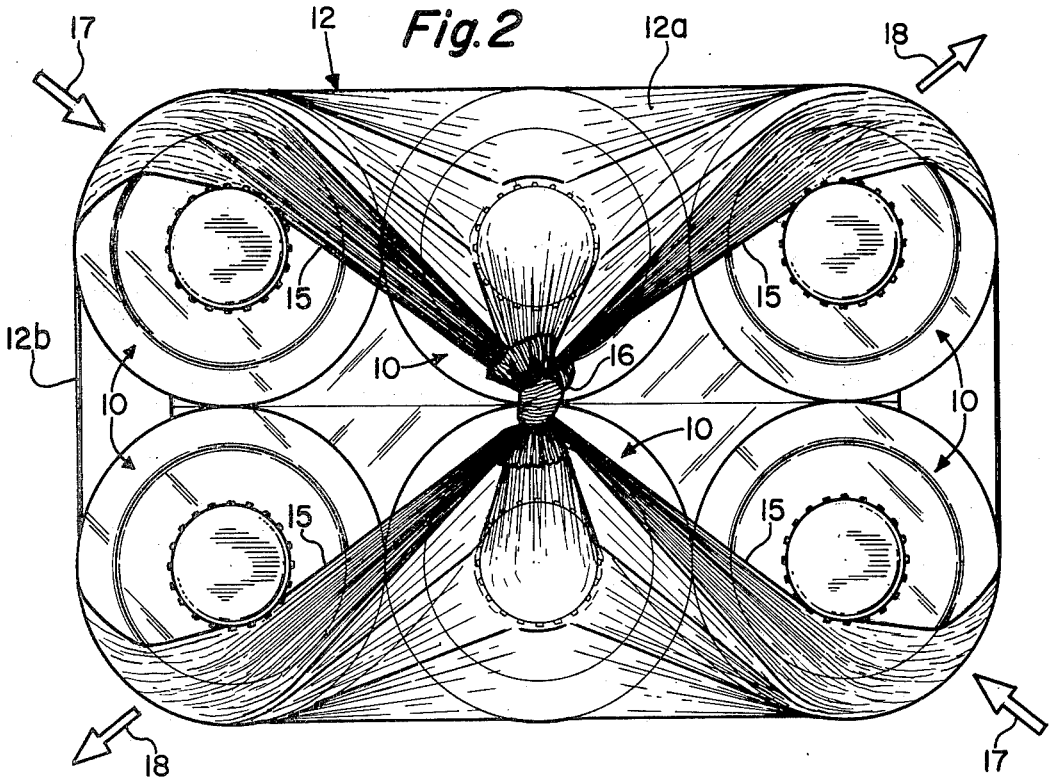
FIG. 2 is a top plan view of the multipackage of FIG. 1.
Figure 3:
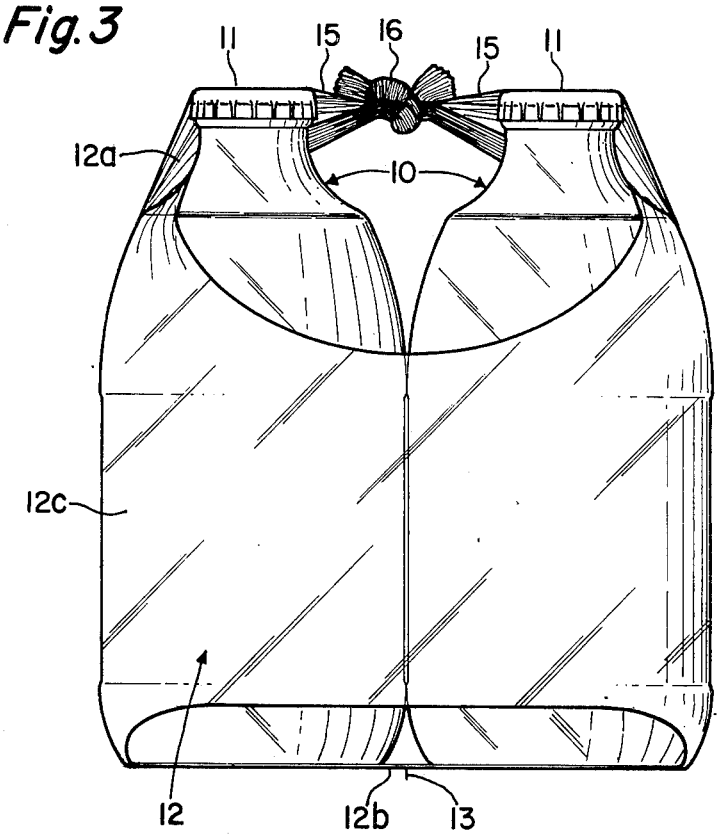
FIG. 3 is an end elevation of the multipackage of FIG. 1.
Figure 4:
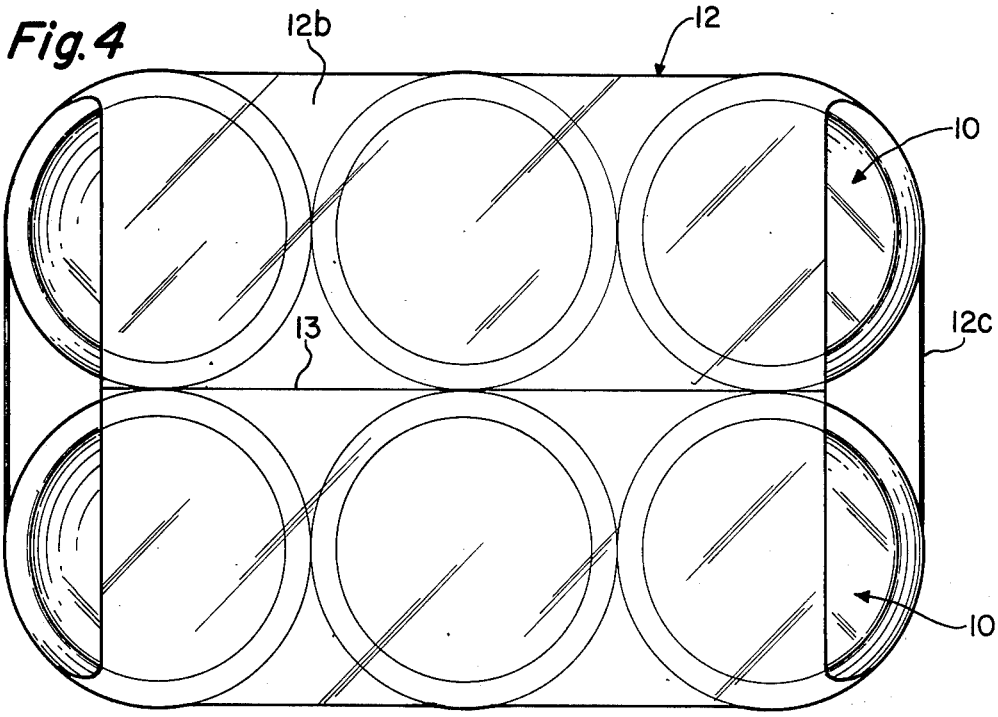
FIG. 4 is a bottom plan view of the multipackage of FIG. 1.

The width of the bottom wall portion 12*b* of the bag-like device 12 is preferably twice the diameter of the base portion of the bottles 10 in the multipackage of FIGS. 1 - 4. In the two rows of three ranks of bottles shown in FIG. 4, it may be seen that the length of the bottom wall 12*b* is less than three times the diameter of the bottles 10 at their base portions. That length is preferably great enough to cover more than half of the base of the bottles of the end ranks of bottles, as shown in FIG. 4.

Preferably the upper edges of the band portion 12*c* at the ends of the multipackage merge into the flaps 12*a* through a smooth curve of large radius as shown in FIG. 8 to aid in distributing the bottle load through the band portion 12*c* to the tensioned truss elements formed by the flaps 12*a*. That curve of the sides of the flaps 12*a*, in the multipackage, appears as a shallow U-shaped end wall as shown in FIG. 3. That arrangement results in a minimum use of material and yet provides for a secure anchor of the ends of the tensioned truss elements formed by the flaps 12*a* as may be seen in FIGS. 1 - 3. That cooperation between the band portion 12*c* and the flaps 12*a* in the completed multipackage is easier taught and understood in the showing in FIGS. 1 - 3 than perhaps by a word description.

In the assembly of the multipackage of the subject invention a leading bag-like device 12 is separated from the strip shown in FIG. 8, opened into the side and bottom wall shape shown in FIGS. 1 - 4, and the six bottles 10 of the embodiment of FIGS. 1 - 4 are then inserted into the bag-like device with the bottles resting upon the bottom wall portion 12*b* and with the band portion 12*c* encircling the peripheral sidewall surface of the group of bottles 10 in the rectangular pattern of two adjacent rows and in transverse ranks perpendicular to the rows as shown. By any suitable means known in the art, the opposed flaps 12*a* are then gathered together, about and over the group of bottles 10. In that operation, the material of the flaps 12*a* must be sufficiently tensioned to form the tensioned truss elements 15. In the embodiment of FIGS. 1 - 4, each tensioned truss element 15 may be described as primarily extending from one corner of the rectangle defined by the group of bottles 10 to the center of the rectangle. As those skilled in the art will understand, the tensioned truss elements 15 are not narrow straight struts, but tend to diverge toward the package corners, and to curve downwardly and about the necks of the corner bottles to a degree and particular configuration determined to a large extent by the neck configuration of the bottles. The upper portion of the package comprises not only the primary truss elements, but secondarily include the gathered material of each flap 12*a* between the truss elements thereof. The gathered material of each flap 12*a* between the truss elements thereof serves to hold the center rank of bottles 10 securely together. Note in the embodiment of FIGS. 1 - 4 that the gathered flaps 12*a* cover the bottle caps 11 of the bottles of the center rank of bottles 10. The invention contemplates that in some embodiments involving six containers, holes may be provided in the flaps so that the caps 11 of the bottles of the center rank of bottles can extend therethrough.

The side marginal portions of the flaps 12*a* which form the tensioned truss elements 15 in combination with the bottles 10 and the remainder of the bag-like device 12 substantially prevent the group of bottles 10 from skewing out of the rectangular pattern into a parallelogram pattern during normal handling of the package. The tensioned truss elements 15 are joined in the embodiment of FIGS. 1 - 4 by a knot tie 16 to form a pair of secured intersecting tensioned truss elements extending diagonally from opposite corners of the group of bottles 10. The knot tie 16, or any equivalent securement between the truss elements 15, must be such as to avoid a loss of tension in those truss elements as the securement is made and as the package is later normally handled. Generally, the tension in the secured intersecting truss elements should be such that in anticipated normal handling of the package in its chain of distribution from manufacture to a purchaser's home, such handling will not cause stretching of the tensioned truss elements to lengths representing an increase by more than about 18% of the original lengths of the tensioned truss elements. In the described arrangement, the integrity and stability of the package in the rectangular configuration as shown in FIG. 2, is achieved against normal handling forces and particularly against forces applied against the corners of the package such as the opposed compressive forces applied in the directions of the arrows 17 in FIG. 2. From a study of FIG. 2 it can be seen that the tensioned intesecting truss elements disposed diagonally across the corners of the package opposite from the arrows 17 will prevent the package from skewing into a parallelogram configuration. In other words, the corner bottles will be prevented from moving outwardly or apart in the direction of the arrows 18 shown in FIG. 2 by the truss element extending between those corner bottles.

FIGS. 11 and 12 show two examples of other forms of securement for the tensioned truss elements 15. In FIG. 11 a wrapped tape 20 produces the secured intersection. FIG. 12 shows the use of a C-shaped or split ring 21, preferably made of metal and tightly clamped about the intersection of the tensioned truss elements 15 to produce the necessary secured intersection. The invention contemplates that other forms of securements known in the art may be used. Two-piece or hinged clamps which are easily opened by a person may also be used as long as they do provide a secure non-slipping intersection of the tensioned truss elements 15 in their closed or locked condition.

In addition to the package integrity and stability provided by the multipackage construction of FIGS. 1-4, the secured intersection of the tensioned truss elements produced by the knot tie 26, the tape wrap 20 or the split ring 21, provides an excellent finger carrying arrangement for the multipackage. The secured intersection is of a reduced cross-sectional area and is circumferentially open in a vertical plane extending longitudinally centrally of the multipackage. Thus, a person may easily encircle one or two fingers under and about the secured intersection and in a comfortable and convenient hand grasping arrangement carry the multipackage. In contradistinction to many known prior art devices, no reinforcement of the thin material of the bag-like device is needed. Because of the gathering and securement of the flaps 12*a* as described, the total load of the containers is fairly evenly distributed throughout the entire area of both flap elements 12*a* to the described handle element, the secured intersection of the tensioned truss elements.

To open the multipackage of the subject invention to remove the individual bottles for use, the invention contemplates that the knot 16 may be untied, the tape 20 may be unwrapped, or the upper portion of the package may merely be cut with an implement such as scissors. If the material of the bag-like device is sufficiently elastic, the upper end of one of the bottles of the end ranks of bottles may be grasped and pulled and twisted from the package. The bag-like device will then be loose, and each of the other bottles may easily be lifted from the bag-like device. It is further contemplated that in some arrangements the bottom seam or heat seal 13 may be made fracturable if the form of weakening or tear strip used does not permit accidental separation of the bottom wall 12*b* in normal handling of the package. Because horizontal forces are often applied against the sidewalls of the package in the normal handling of such a package, package opening strips in the band portion 12*c* should be avoided unless any such package opening arrangement is at least as strong as the material of the bag-like device against forces applied to the package in normal handling of the package.

Figure 5:
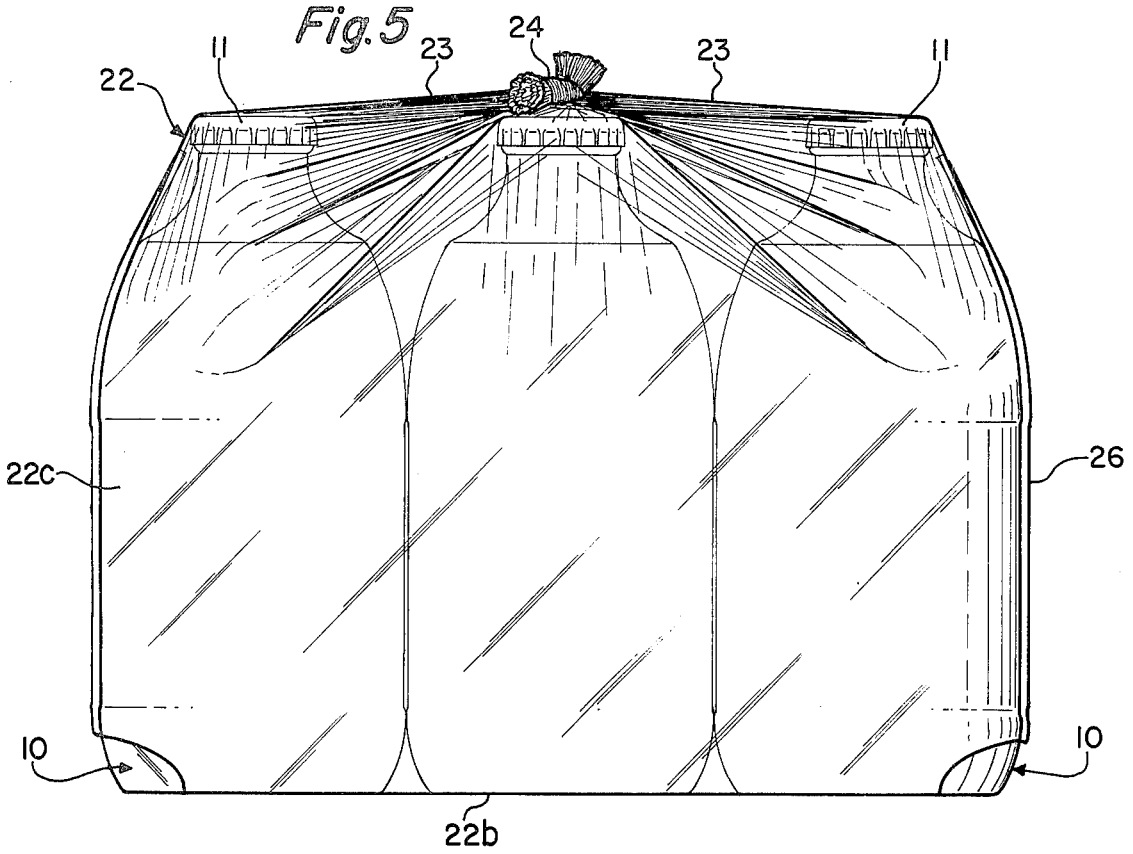
FIG. 5 is a side elevational view of another embodiment of a multipackage constructed according to the invention.
Figure 6:
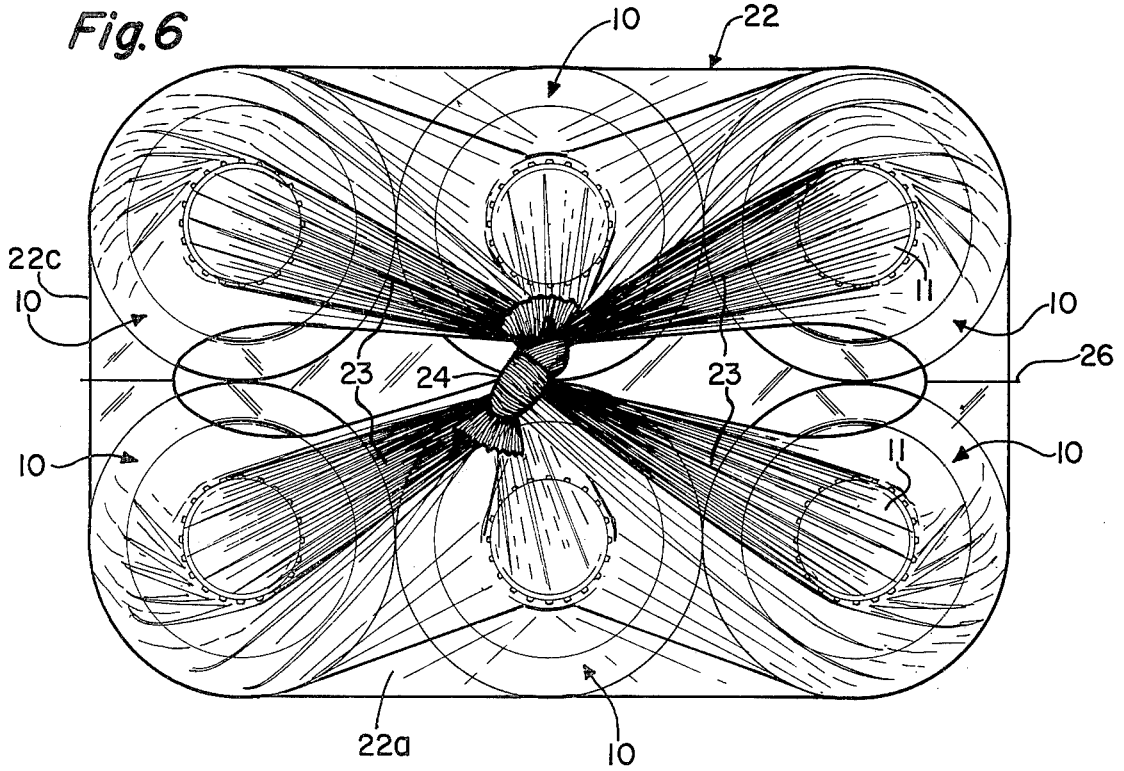
FIG. 6 is a top plan view of the multipackage of FIG. 5.
Figure 7:
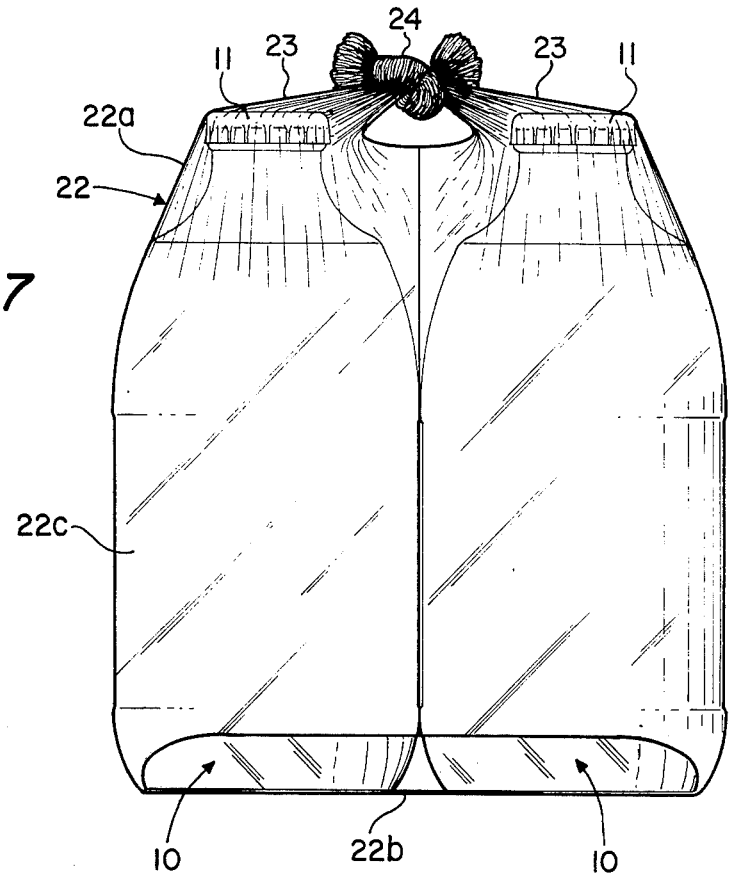
FIG. 7 is an end elevational view of the multipackage of FIG. 5.

The embodiments of FIGS. 5–7 essentially differs from the embodiment of FIGS. 1–4 in that the bag-like device 22 has flaps 22*a* that are substantially wider than the flaps 12*a* of the bag-like device 12. The sides of the flaps 22*a* extend substantially along the upper marginal edges of the end walls of the band portion 22*c* in the multipackage of FIGS. 5–7. When the flaps 22*a* are gathered and secured in making the multipackage of FIGS. 5–7, the flaps 22*a* cover the caps 11 of all of the bottles of the package. As may be seen in FIG. 6, even though the flaps 22*a* have substantial width, they still may be appropriately gathered and secured between the bottles of the center rank of bottles to produce secured intersecting tensioned truss elements equivalent to the secured intersecting tensioned truss elements of FIGS. 1–4. The tensioned truss elements of the multipackage of FIGS. 5–7 are indicated at 23 and, as can be seen in FIG. 6, the ends of the truss elements 23 at the corners of the package have a width sufficient to include the caps 11 of the bottles 10. The intersection of the tensioned truss elements 23 may be secured by a knot at 24 similar to knot tie 16, or the alternative securements such as those of FIGS. 11 and 12 may also be used. In all other respects the multipackage of FIGS. 5–7 is equivalent to the embodiment of FIGS. 1–4.

Figure 10:
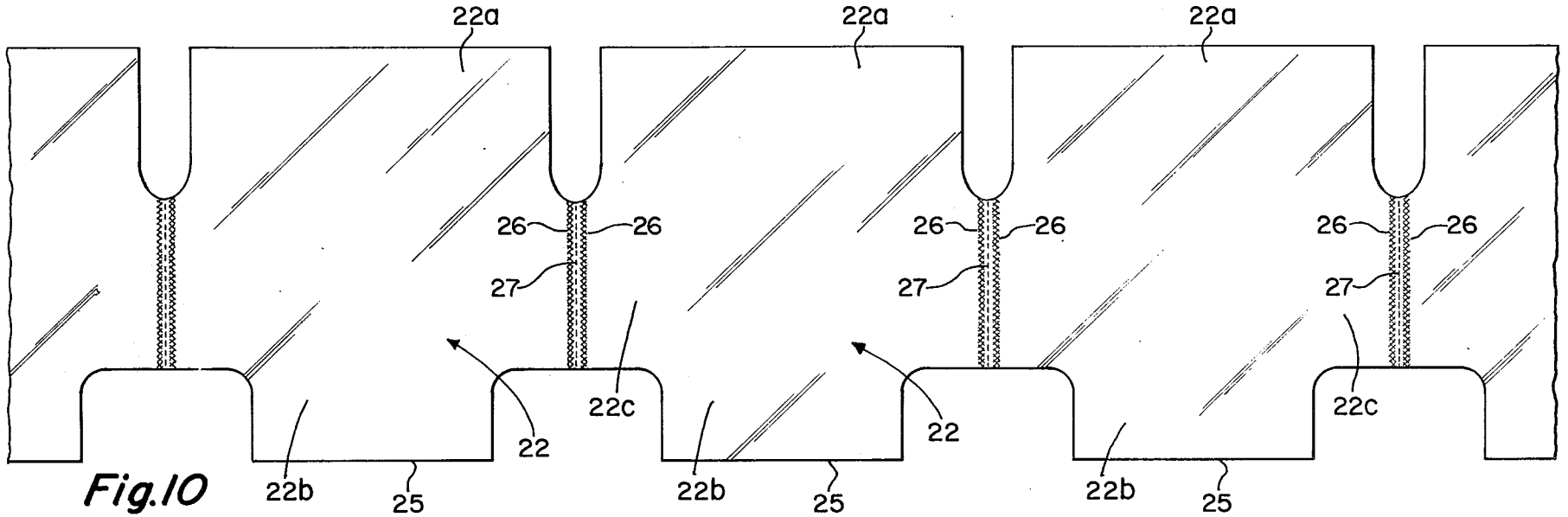
FIG. 10 is a reduced plan view of a strip of bag-like devices used in the construction of multipackages of FIGS. 5 - 7, and showing one embodiment of the manufacture of those bag-like devices.

The bag-like device 22 of the embodiment of the invention shown in FIGS. 5–7 may be manufactured in a strip such as shown in FIG. 10. As shown in FIG. 10, the material of the strip is conveniently a sheet material that has been folded on the line 25. The fold-line 25 is thus the longitudinal center line of the bottom wall 22*b* of the bag-like device 22. The folded sheet material is cut or punched as shown in FIG. 10 to define a series of bag-like devices joined along the end sidewalls of the band portions 22*c*. Complete bag devices 22 which may be separated from the strip are produced by the two heat sealed lines 26 with a perforation line 27 therebetween. Other sidewall fastening means can be used in place of the heat sealed lines 26, but in any contemplated sealing or fastening arrangement, the handling forces normally applied to the band portion 22*c* of the package must be kept in mind and the heat seal lines 26 or other fastening means preferably should have at least the strength of the material of the band portions 22*c* in order that the thinnest practical material may be used for making the bag-like devices 22.

The stock of FIGS. 8 and 10 for producing connected series of bag-like devices is only intended to show a number of potentially economical ways in which the bag-like devices may be made. Other manufacturing processes may be used within the scope of the invention to make the bag-like devices of the multipackages of the invention.

Further, the ends of the bottom walls of the bag-like devices as shown and described are not connected to the lower edges of the end sidewalls of the band portions. That showing is intended to teach multipackages within the scope of the invention using a minimum of material. However, it is contemplated that if desired, additional material can be provided in the area of the junction of the end walls and bottom wall of the bag-like devices to produce a gusseted bag.

Having described the invention it is to be further understood that other changes can be made in the described embodiments by one skilled in the art within the spirit and scope of the invention as defined in the claims.

I claim:

1. A multipackage of a group of containers and a bag-like device, said group of containers arranged in two adjacent rows and in transverse ranks perpendicular to said rows, each of said containers having a capped upper end of a smaller diameter than the lower body portion thereof, said bag-like device having integral bottom and side walls formed of a thin flexible material substantially enveloping and in stretched engagement with the bottom and the outer side peripheral surface of said group of containers, the upper end of said bag-like device on the upper end of two opposed sidewalls thereof being gathered and stretched about the upper portions of said containers and secured in the area of the tops of said containers forming secured tensioned truss elements, said truss elements extending diagonally from opposite corners of said group of containers and being sufficiently tensioned between said opposite corners to substantially prevent skewing of said group of containers out of said transverse ranks perpendicular to said rows, and two opposed sides of said truss elements in the area of their securement being of reduced cross section and circumferentially open to form a handle element capable of being encircled by a person's finger.

2. In a multipackage as defined in claim 1, said thin flexible material comprising a resilient elastic plastics material.

3. In a multipackage as defined in claim 1, wherein said groups of containers comprises three ranks in said two adjacent rows, and the securement of said tensioned truss elements being substantially midway between the bottles of the center rank of two containers.

4. In a multipackage as defined in claim 3, wherein said truss elements are directed from said opposite corners of said group of containers about and below the caps of the containers of the end ranks of containers and extend substantially between the end ranks of containers and the center rank of containers to said securement of said tensioned truss elements substantially midway between the containers of the center rank of containers.

5. A multipackage as defined in claim 4, and said material of said upper end of said bag-like device covering the caps of the containers of the center rank of containers.

6. A multipackage as defined in claim 3, wherein the material of said upper end of said bag-like device overlies the caps of all of said containers, and the ends of said truss elements overlie and substantially horizontally include the caps of the containers of the end ranks of containers.

7. A multipackage of a group of bottles and a bag-like device, said group of bottles arranged in two adjacent rows and in transverse ranks perpendicular to said rows, each of said bottles having a capped upper end of a substantially smaller diameter than the lower body portion thereof, said bag-like device formed of a thin flexible material and having four integral interconnected sidewalls and a bottom wall, said bottom wall integrally interconnected between the lower edges of at least two opposed sidewalls of said four sidewalls, said group of bottles being disposed in said bag-like device on said bottom wall with said four sidewalls in substantially stretched engagement with the outer side peripheral surface of said group of bottles, the upper ends of said two opposed sidewalls having integral flaps, said flaps being gathered and stretched about the upper portions of said bottles and secured together in the area of the caps of said bottles forming secured tensioned truss elements, said truss elements extending diagonally from opposite corners of said groups of bottles and being sufficiently tensioned between said opposite corners in cooperation with said four sidewalls to substantially lock said group of bottles against skewing in said arrangement of two adjacent rows and in transverse ranks perpendicular to said rows, and the secured tensioned truss elements in the area of their securement being circumferentially open to form an integral handle element capable of being encircled by a person's finger.

8. A multipackage as defined in claim 7, the securement of said tensioned truss elements comprising a tied knot of said gathered and stretched flaps.

9. A multipackage as defined in claim 7, the securement of said tensioned truss elements comprising a length of tape securely wrapped about the gathered flaps at the securement position of said tensioned truss elements.

10. A multipackage as defined in claim 7, the securement of said tensioned truss elements comprising a split ring securely clamped about the gathered flaps at the securement position of said tensioned truss elements.

11. A multipackage as defined in claim 7, wherein said thin flexible material comprises a resilient plastics material.

12. A multipackage as defined in claim 7, wherein said bag-like device is formed from a tubular material with the axis of the tube aligned parallel to the longitudinal axes of said bottles in said multipackage.

13. A multipackage as defined in claim 7, wherein said group of bottles comprises three ranks in said two adjacent rows, and said securement of said tensioned truss elements being positioned substantially midway between the bottles of the center rank of bottles.

14. A multipackage as defined in claim 13, wherein said truss elements are directed from said opposite corners of said group of bottles about and below the caps of the bottles of the end ranks of bottles and extend substantially between the end ranks of bottles and the center rank of bottles to said securement of said tensioned truss elements substantially midway between the bottles of the center rank of bottles.

15. A multipackage as defined in claim 14, and said material of said flaps of said bag-like device covering the caps of the bottles of the center rank of bottles.

16. A multipackage as defined in claim 13, wherein the material of said flaps of said bag-like device overlies the caps of all of said bottles, and the ends of said truss elements overlie and substantially horizontally include the caps of the bottles of the end ranks of bottles.

17. A bag-like device for multipackaging of bottles in two adjacent rows and in transverse ranks perpendicular to said rows in which each of said bottles has a capped upper end of a substantially smaller diameter than the lower body portion thereof, said bag-like device formed of a thin flexible material and comprising four integral interconnected sidewalls and a bottom wall integrally interconnected between the lower edges of two opposed sidewalls of said four sidewalls of said bag-like device, a pair of flaps of said material integrally formed on the upper ends of said two opposed sidewalls, said four sidewalls and said bottom wall being shaped to substantially closely envelop and engage said group of bottles in a stretched condition in said arrangement of two adjacent rows and in transverse ranks perpendicular to said rows when said group of bottles are placed in said bag-like device, and said flaps being shaped in cooperation with said four sidewalls to be capable of being gathered, tensioned and secured against the upper portions of said bottles and in the area of the caps of said bottles forming secured truss elements tensioned between opposite corners of said group of bottles with said truss elements extending diagonally from opposite corners of said group of bottles and under sufficient tension to substantially prevent skewing of said groups of bottles out of said transverse ranks perpendicular to said rows.

* * * * *